US007438743B2

(12) United States Patent
Strauss

(10) Patent No.: US 7,438,743 B2
(45) Date of Patent: Oct. 21, 2008

(54) METHOD OF MAKING REPLACEMENT COLLECTING ELECTRODES FOR AN ELECTROSTATIC PRECIPITATOR

(75) Inventor: Robert A. Strauss, Raritan, NJ (US)

(73) Assignee: Hamon Research -Cottrell, Inc., Somerville, NJ (US)

( * ) Notice: Subject to any disclaimer, the term of this patent is extended or adjusted under 35 U.S.C. 154(b) by 0 days.

(21) Appl. No.: 11/705,848

(22) Filed: Feb. 13, 2007

(65) Prior Publication Data

US 2007/0193445 A1 Aug. 23, 2007

Related U.S. Application Data

(60) Provisional application No. 60/775,889, filed on Feb. 23, 2006.

(51) Int. Cl.
*B03C 3/86* (2006.01)

(52) U.S. Cl. ..... 95/57; 55/DIG. 38; 96/83; 96/92; 96/94

(58) Field of Classification Search ..... 96/32–38, 96/83, 86, 87, 89, 92, 94, 98–100; 95/57, 95/74, 76; 55/DIG. 38
See application file for complete search history.

(56) References Cited

U.S. PATENT DOCUMENTS

| | | | | | |
|---|---|---|---|---|---|
| 1,584,055 | A | * | 5/1926 | Weiskopf | 96/92 |
| 1,846,169 | A | * | 2/1932 | Weiskopf | 96/84 |
| 2,711,224 | A | * | 6/1955 | Herber | 96/89 |
| 2,999,561 | A | * | 9/1961 | Phyl | 96/89 |
| 3,688,475 | A | * | 9/1972 | Dyla et al. | 96/92 |
| 3,729,815 | A | * | 5/1973 | Quintilian et al. | 29/592.1 |
| 3,759,014 | A | * | 9/1973 | Van Dyken et al. | 95/76 |
| 4,303,418 | A | * | 12/1981 | Coe, Jr. | 96/86 |
| 4,325,714 | A | * | 4/1982 | Wooldridge | 96/86 |
| 4,360,367 | A | * | 11/1982 | Prior | 96/87 |
| 4,375,364 | A | * | 3/1983 | Van Hoesen et al. | 96/87 |
| 4,516,992 | A | * | 5/1985 | Jonelis | 96/87 |
| 4,559,064 | A | * | 12/1985 | Ahern | 96/87 |
| 4,747,856 | A | * | 5/1988 | Hicks et al. | 96/86 |
| 4,840,649 | A | * | 6/1989 | Jonelis et al. | 96/94 |
| 4,948,399 | A | * | 8/1990 | Reuffurth et al. | 96/92 |
| 5,344,481 | A | * | 9/1994 | Pettersson | 96/33 |
| 5,366,540 | A | * | 11/1994 | Bojsen | 96/33 |
| 5,529,608 | A | * | 6/1996 | Jonelis | 95/57 |
| 5,665,147 | A | * | 9/1997 | Taylor et al. | 96/72 |
| 6,048,385 | A | * | 4/2000 | Koide | 96/83 |
| 6,579,349 | B1 | * | 6/2003 | Ting et al. | 96/44 |
| 2007/0193449 | A1 | * | 8/2007 | Smith | 96/83 |

FOREIGN PATENT DOCUMENTS

| | | | | |
|---|---|---|---|---|
| DE | 4117973 | A1 * | 12/1992 | 55/DIG. 38 |

* cited by examiner

*Primary Examiner*—Richard L Chiesa
(74) *Attorney, Agent, or Firm*—Howard & Howard Attorneys, P.C.

(57) ABSTRACT

A method of forming a modular collecting electrode for an electrostatic precipitator, including forming a plurality of horizontal collecting electrode sections, each section having vertical planar portions separated by vertical tubular portions, and wherein the method includes inserting interconnecting support elements into the tubular portions of adjacent collector electrode sections and compressing the interconnected electrode sections to form a rigid modular assembly. In one preferred embodiment, the method includes applying stiffening members across the ends of the planar portions of adjacent electrode sections for transmitting rapping forces through the assembled sections.

19 Claims, 8 Drawing Sheets

METHOD OF MAKING REPLACEMENT COLLECTING ELECTRODES FOR AN ELECTROSTATIC PRECIPITATOR

RELATED APPLICATION

This application claims priority to U.S. Provisional Patent Application Ser. No. 60/775,889 filed Feb. 23, 2006.

FIELD OF THE INVENTION

This invention relates a method of making modular rigid collecting electrodes for replacement in situ of damaged collecting electrodes or reconfiguration of or general rebuild of an electrostatic precipitator without requiring removal of the casing or superstructure of the electrostatic precipitator, thereby significantly reducing costs and down time during repair.

BACKGROUND OF THE INVENTION

Electrostatic precipitators are an efficient and economic way of collecting particulates suspended in a waste gas stream. The electrostatic precipitator technology was first invented and implemented in the early 1900s by Research-Cottrell, the predecessor in interest of the assignee of this application.

In the electrical precipitation process of an electrostatic precipitator, a chamber filled with large parallel spaced conductive panels, referred to as collecting electrodes, are supported in parallel relation from anvil beams. In a typical application, the collecting electrodes are rigid and may be about 10 to 55 feet in length, have a width of between about 4 and 12 feet and weigh between 400 and 2,000 pounds or greater. Further, an electrostatic precipitator may include about 10 to 400 collecting electrodes. In a preferred embodiment of a collecting electrode developed by the predecessor in interest of the assignee of this application, the collecting electrodes each include vertically extending planar collecting portions separated by vertical tubular portions. In a preferred embodiment, the tubular portions are generally diamond-shaped, preferably having rounded edges and thus the collecting electrodes include a triangular shaped projecting portion on opposed sides of the collecting electrodes as will be understood by those skilled in this art. The collecting electrodes may be made by forming two generally planar metal panels, forming parallel triangular-shaped projections and welding the panels together to form planar collecting portions separated by diamond-shaped tubular portions.

At the center point, running parallel between the collecting electrodes, are a series of individual discharge electrodes that run vertically the full height of the collecting electrodes. These may be small diameter wires or more typically today rigid "mast-type" assemblies having pointed projections. The discharge electrode assembly is supported on an insulated assembly to keep the discharge electrodes electrically separate from the collecting electrodes.

A high voltage direct current (D.C.) is applied to the opposing surfaces of the collecting and discharge electrodes, wherein the positive charge (+) is applied to the collecting electrodes and the negative charge (−) is applied to the discharge electrodes. With electron flow from negative to positive, the small surfaces of the discharge electrodes emit a field of negative electrons or ions in the space between the collecting electrodes. When a particulate laden or polluted waste gas is passed at low velocity through this electron field, the particulates in the gas stream will become negatively charged.

The negatively charged particles will then be attracted to the positive charge on the collecting electrodes. When this migration toward the surface is complete, the inherent resistivity of the particles will prevent complete loss of the charge through the collecting electrode surface. The retained opposing electrical charge in the particles will cause the particles to agglomerate or stick to the surfaces of the collecting electrodes. Electrostatic precipitators have now become the equipment of choice in pollution abatement applications, wherein the gas stream has fine particulate material in the exhaust gas, including industrial and utility coal and oil fired boilers, the paper and pulp industry, refineries and other pollution abatement applications. In the last half of the twentieth century, as such industries grew and environmental issues became more important, there was a big demand for larger and more efficient electrostatic precipitators. More recently, environmental regulations have become so strict that even the slightest emission violation or a fundamental loss of a part of a precipitator, can result in heavy fines and production cutbacks and shut down.

These requirements have caused major changes in the physical design of electrostatic precipitators, including greater sectionalization of the electrostatic precipitators having several small electrical sections or chambers to increase efficiency and reduce loss percentage in the event of a failure and changes in the design of many of the system components. Two of the main changes have been in the area of collecting and discharge electrodes. While the original small diameter wire design was very efficient electrically and cost efficient, the small diameter wire design was prone to breakage and failure, particularly due to age, sparking and stress from the precipitator internal cleaning rapping or vibration system which causes the agglomerated particulates to fall from the collecting electrodes. Wire discharge electrodes are being replaced with rigid mast-type electrodes, which are more rugged in design. Collecting electrodes also had to be made stronger so that they could maintain closer tolerances and surface design had to be improved to make them more efficient in both material collection and cleaning.

As will be understood by those skilled in this art, the positively charged collecting electrodes collect particulate materials which must be periodically removed from the collecting surfaces. The particulate material is removed from the collecting electrodes by "rapping" forces applied to the collecting electrodes. Rapping forces may be applied to the collecting electrodes by vibrators, hammers or magnetically, and the dislodged particulate material then drops into collecting hoppers located below the collecting electrodes. Thus, the collecting electrodes must be able to withstand and provide uniform rapping forces throughout the plate surfaces for overall cleaning efficiency. The Opzel™ collecting electrode available from the assignee of this application includes vertical planar collecting surfaces separated by vertical diamond-shaped tubular portions having triangular projecting surfaces on opposed sides of the collecting electrodes, as described above, together with improved rigid mass-type discharge electrodes which has proven to be a reliable answer to the problems of discharge and collecting electrode failure. However, while the issues of normal operational collecting and discharge electrode failure has been resolved, there will still be failures that relate to general aging, or failure due to temperature surges caused by process upset conditions or precipitator fires which can damage or destroy the internal components of the electrostatic precipitator.

As will be understood by those skilled in this art, it is very difficult and expensive to replace the collecting electrodes of an electrostatic precipitator. Replacement of the collecting electrodes results in lengthy down time for the precipitator, always requiring that the entire electrostatic precipitator and process be shut down. To replace conventional rigid collecting electrodes, it is generally necessary to cut holes in the precipitator roof, also generally requiring cutting holes in surrounding building structure and cranes to lift and lower the collecting electrodes into place. There are also many instances where the owner of the electrostatic precipitator desires to upgrade an older existing precipitator that has good external casing, but may suffer from frequent failure of the internal electrical components or require efficiency or reliability upgrades. In those cases, it is necessary to remove the upper structure of the precipitator and employ cranes and large forces of welders and laborers to perform the upgrade. Replacement of the collecting electrodes also requires shut down of the apparatus generating the waste gas stream.

Thus, there has been a long felt need for a method of replacing collecting electrodes of an electrostatic precipitator which substantially reduces extensive down time for the precipitator, avoids cutting large holes in the precipitator roof and the surrounding casing and large cranes to lift and lower the collecting electrodes in place and eliminates the requirement for special tools and welding equipment. The method of making replacement collecting electrodes for an electrostatic precipitator of this invention solves these problems by forming or making small collecting electrode sections which may easily be shipped from the manufacturing site to the precipitator and passed through a small opening in the precipitator casing and reliably reassembled in the cramped conditions within a precipitator. Further, the collecting electrode sections of this invention may be reassembled into a rigid large collecting electrode able to withstand and transmit rapping forces for cleaning and has all of the advantages of a conventional modern rigid collecting electrode. Other advantages and meritorious features of this invention will be more fully understood from the following summary of the invention, description of the preferred embodiments and the appended drawings.

SUMMARY OF THE INVENTION

The method of making a replacement collecting electrode for an electrostatic precipitator of this invention includes forming a plurality of vertical collecting electrode sections, wherein each section includes spaced planar collecting electrode portions separated by spaced vertical tubular portions, wherein the tubular portions may be coaxially aligned for assembly. As used herein, the term "vertical" refers to the final orientation of the planar collecting portions and tubular portions. The collecting sections are then aligned with the vertical tubular portions coaxially aligned. The method of this invention then includes inserting interconnecting support rods into the opposed tubular portions of the adjacent collecting sections and forming a plurality of aligned interconnected collecting sections. As used herein, the term interconnecting support "rod" includes a solid or tubular rod, but in a preferred method of compressing the interconnected collector sections disclosed herein, the interconnecting rods are tubular. Finally, one preferred embodiment of the method of this invention includes compressing the interconnected collecting sections to form a rigid assembly of interconnected collecting sections able to withstand and transmit rapping forces. In one preferred embodiment of the method of this invention, the collecting sections are assembled within the electrostatic precipitators, as described further below. The vertical tubular portions may be diamond-shaped, as described above, providing superior performance. However the tubular portions of the collecting electrode sections may be any tubular shape which permits interconnecting the collecting electrode sections as described.

In one preferred embodiment of the method of forming replacement collecting electrodes of an electrostatic precipitator of this invention, the method includes hanging a first of the vertical collecting section, preferably on a winch or the like, such that the first collecting electrode section hangs vertically. The method then includes inserting interconnecting support rods into the tubular portions of a second collecting electrode section with the interconnecting support rods projecting from the tubular portions of the second collecting electrode section. The method then includes aligning the projecting interconnecting support rods of the second collecting section with the tubular portions of the first collecting electrode section and preferably raising the second collecting electrode section, thereby receiving the projecting interconnecting support rods of the second collecting electrode section into the tubular portions of the first collecting electrode section and interconnecting the first and second collecting electrode sections. Lowering the first collecting electrode section to the second collecting electrode section is optional, but collecting electrode sections may also be assembled on a horizontal work surface. The first and second collecting electrode sections may be temporarily interconnected prior to final assembly and compression by any suitable means, such as hooks received through openings formed in the adjacent tubular portions. This process is then repeated by raising the interconnected first and second collecting electrode sections with a winch or the like, inserting interconnecting support rods into the tubular portions of a third collecting electrode section, aligning the projecting connecting support rods of the third collecting electrode section with the tubular portions of the second collecting section as described above and raising the third collecting electrode section to receive the projecting interconnecting support rods in the tubular portions of the third collecting electrode section into the tubular portions of the second collecting electrode section, interconnecting the third electrode section to the second electrode section and repeating the process until the required length of the collecting electrode is achieved. The method of this invention further includes compressing the interconnected collecting electrode sections to form a rigid collecting electrode assembly as required for the application which may have a length of 50 feet or greater, as described above.

The rigidity of the collecting electrode of this invention may be further improved by first inserting anvil pipes into the opposed ends of adjacent tubular portions of the vertical collecting sections and permanently affixing the anvil pipes in the tubular portions of the collecting electrode sections, such as by welding the anvil pipes in the tubular portions at the place of manufacture of the collecting electrode sections This embodiment of the method of this invention then includes inserting the interconnecting support rods having an outside diameter generally equal to or slightly smaller than an internal diameter of the anvil pipes, wherein the anvil pipes add strength and rigidity to the assembled collecting electrode. In one preferred embodiment, anvil pipes are inserted in each end of the tubular portions of the adjacent collecting electrode sections, each having a length less than one-half the axial length of the tubular sections and permanently securing the anvil pipes in place, as by welding. In one preferred embodiment, the anvil pipes include a stop adjacent the inner end of the anvil pipes to prevent the interconnecting support rods from passing through the tubular portions of the collecting electrode sections and providing the correct projecting length or height of the interconnecting support rods. A stop may be provided for example at the inner end of the anvil pipes simply by crimping the end of the anvil tubes received in the tubular portion prior to insertion in the tubular portions of the collecting section.

The rigidity of the assembled collecting electrode and transmission of rapping forces may be further improved by applying a stiffening member or stiffening bar across and between the planar collecting portions between the collecting electrode sections. In this disclosed embodiment, the method of this invention includes applying a generally Z-shaped bar or channel between adjacent planar portions of the collecting sections and receiving an edge of each of the opposed planar collecting portions in the opposed sides of the Z-shaped bar. When the collecting electrode sections are compressed, the opposed ends of the planar collecting portions are received and compressed into the opposed bites or channels of the Z-shaped stiffening bar, forming a rigid overlapping assembly. The collecting electrode sections may be interconnected prior to compressing the interconnected collecting sections by any suitable means, such as by clips or other fastening means. Finally, the interconnected collecting electrode sections may be permanently compressed by any suitable means, such as by receiving a cable or threaded road through the outside tubes of the collecting electrode assembly and tensioning the cable or rod to form a permanently assembled rigid collecting electrode assembly. The method of this invention may include compressing each of the assembled collecting electrode sections as assembled or compressing the entire assembly following completion of the assembly. This method of internal compression creates an equal and opposite compressive force through the collecting electrode walls and joints of the assembled collecting electrode sections. This insures a rigid mechanical connection and the transmission of the rapping force through the final assembled plate-like planar collecting portions.

The method of making a replacement collecting electrode for an electrostatic precipitator of this invention thus eliminates the need for high lift devices, such as a crane, to raise a single piece large collecting electrodes into the precipitator, eliminates the need to relocate external equipment or make penetrations or holes into existing structures that may block access into the electrostatic precipitator internals, provides a uniform profile of its emission surface so as not to create areas of excess sparking on its surface, maintains correct rigid alignment of the collecting electrode surface, maximizes electrical conductivity across the collecting electrode and provides complete compatibility with existing collecting electrodes. Further, special tools or welding is not required at the site of the electrostatic precipitator because the collecting electrode sections may be manufactured at a manufacturing facility and easily shipped in small sections to the electrostatic precipitator for final assembly.

BRIEF DESCRIPTION OF THE DRAWINGS

FIGS. 14 and 15 are side views of the collecting electrode sections shown in FIGS. 11 to 14 during compression of the sections using tensioning rods;

DESCRIPTION OF THE PREFERRED EMBODIMENTS

The attached drawings illustrate one embodiment of a method of making replacement collecting electrodes for an electrostatic precipitator of this invention. However, as will be understood by those skilled in this art, the disclosed method is provided for illustrative purposes only and various modifications may be made to the disclosed method of this invention within the purview of the appended claims.

Figure 1:
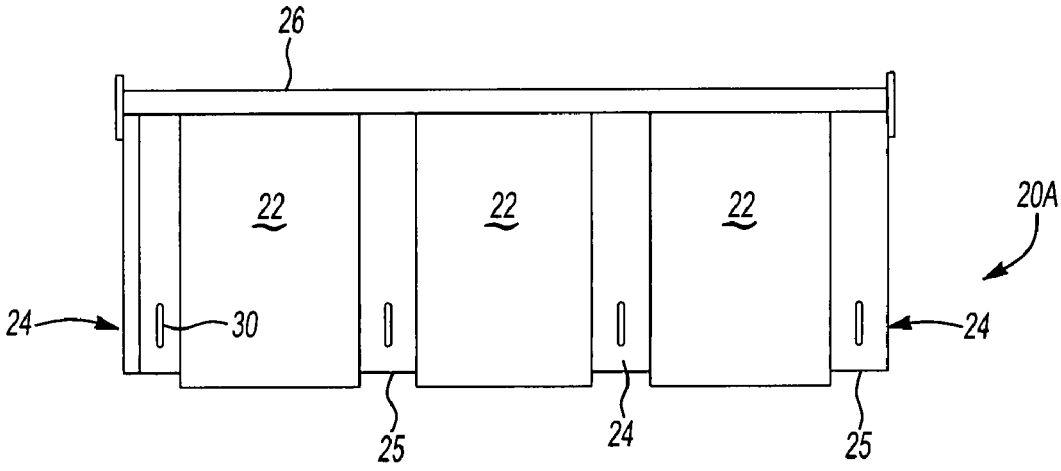
FIG. 1 is a side view of one embodiment of an upper collecting electrode section.
Figure 2:
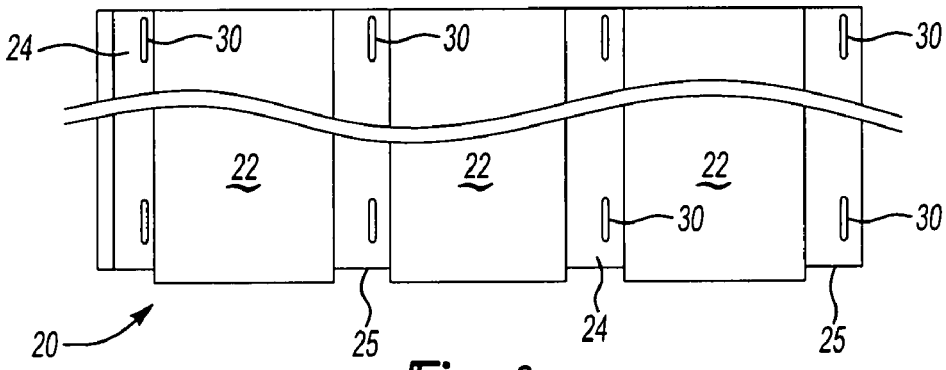
FIG. 2 is a side view of one embodiment of an intermediate collecting electrode section.
Figure 3:
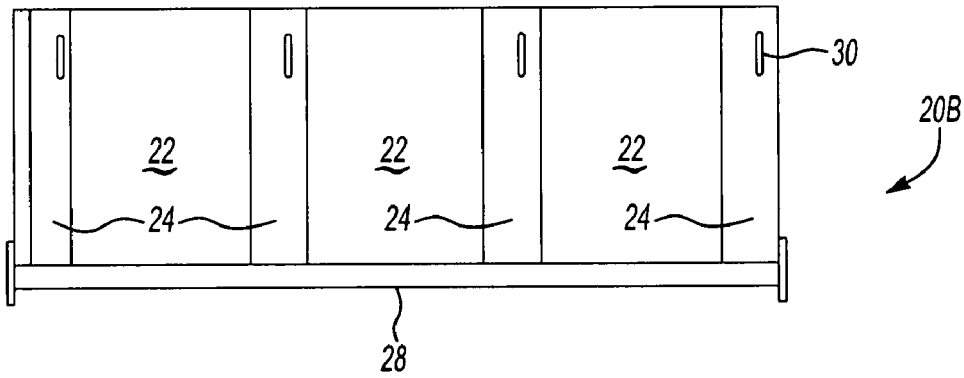
FIG. 3 is a side view of one embodiment of a lower collecting electrode section.
Figure 4:
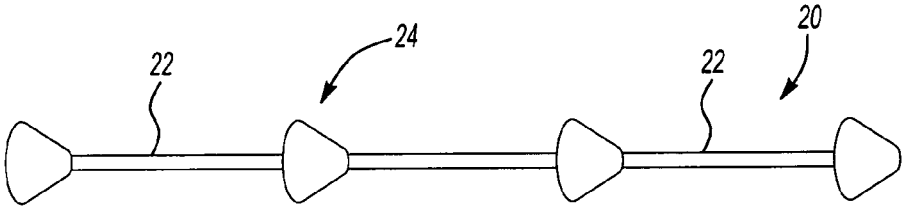
FIG. 4 is a bottom view of one of the collecting electrode sections shown in FIGS. 1 to 3.

A first step of the method of this invention is to form a plurality of collecting electrode sections 20. In one preferred embodiment, the collecting electrode sections are identical or substantially similar to reduce cost and simplify construction as described below. FIGS. 1 to 3 illustrate one embodiment of the collecting electrode sections 20, wherein 20A in FIG. 1 is an upper collecting electrode section and 20B in FIG. 3 is a lower section. For ease of description, the collecting electrode sections will be referred to generically by reference number 20. Each of the collecting electrode sections 20 include vertical planar portions 22 separated by parallel vertical tubular portions 24. As will be understood from the following detailed description of the preferred embodiments of the method of making replacement collecting electrodes for an electrostatic precipitator of this invention, the collecting electrode sections 20 are horizontal in the assembled orientation and the planar collecting portions 22 and the tubular portions 24 are vertical. The number of planar and tubular portions 22 and 24, respectively, will depend upon the application and may include, for example only, four to twelve tubular sections 24 and thus three to eleven planar collecting portions or sections 22 or any other combination of planar collecting portions and tubular portions. In one preferred embodiment, the tubular portions 24 are generally diamond-shaped preferably having rounded edges as shown in FIG. 4, which may be formed by forming the outwardly projecting triangular portion in a metal plate and welding the plates together to form the configuration shown in FIG. 4. This creates a very rugged and efficient construction. FIG. 1 illustrates one embodiment of an upper section 20A and FIG. 3 illustrates a lower collecting electrode section 20B, wherein the upper section 20A includes an upper stiffening beam 26. The stiffening beam 26 may be U-shaped and welded or otherwise permanently secured to the upper end of the upper section 20A and the lower stiffening beam 28 may also be U-shaped and welded or otherwise permanently secured to the lower collecting electrode section 20B. Initially, however, all of the collecting electrode sections 20 may be identical. The upper and lower stiffening beams 26 and 28, respectively, may be U-shaped and welded to the upper end of the upper collecting electrode section 20A and the lower end of the lower collecting electrode section 20B.

Figure 5:
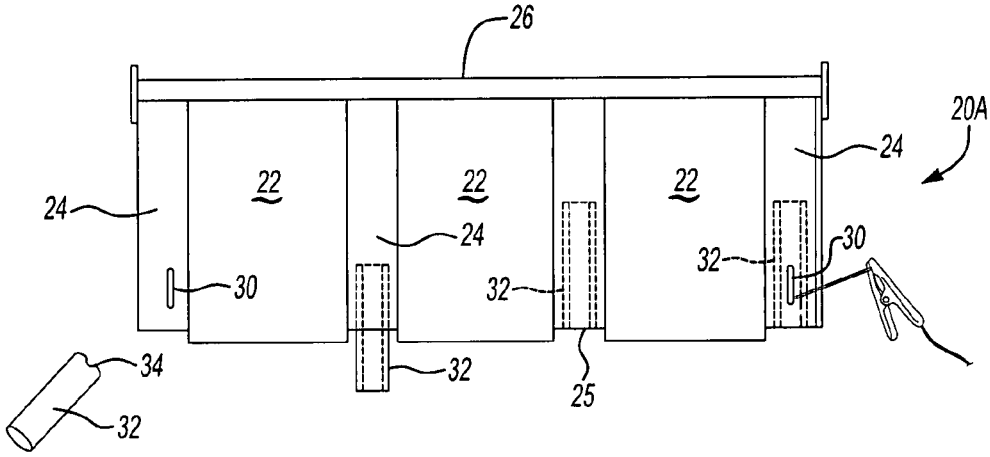
FIGS. 5 to 7 are side views of the collecting electrode sections shown in FIGS. 1 to 3 during installation of anvil pipes.
Figure 6:
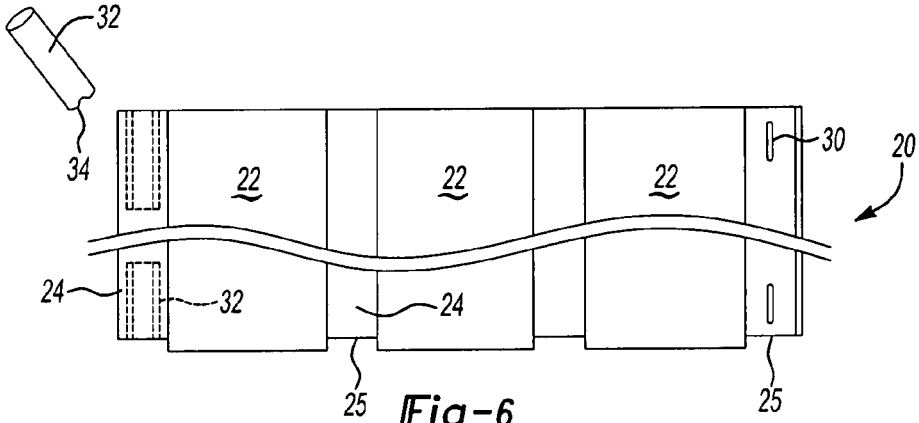
Figure 7:
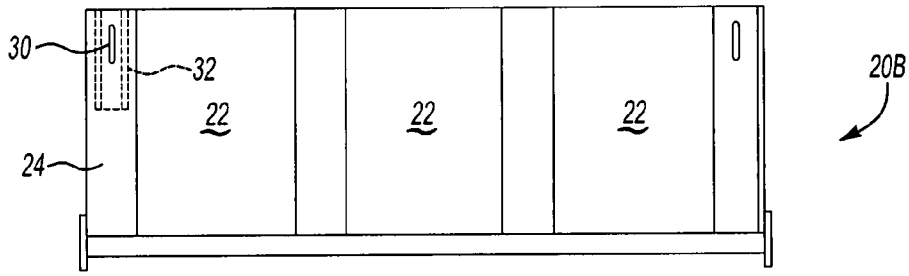

In one preferred embodiment of the method of making replacement collecting electrodes for an electrostatic precipitator of this invention, stiffening bars (38 in FIGS. 11 to 13 and 12A) are also provided between the planar collecting portions 22 which also provide improved transmission of rapping forces through the entire length of the assembled collecting electrode. In the disclosed embodiment, the lower ends 25 of the upper section 20A and the intermediate sections 20 are prepared by cutting a short section 25 from the lower portion of the tubular portions 24, referred to as the "Opzels" are shown in FIGS. 1 and 2. In this embodiment, slots 30 are also cut in the tubular portions 24 for welding the anvil pipes 32 in the tubular portions 24 as shown in FIGS. 5 to 7, discussed below.

As discussed above, it is important that the replacement collecting electrodes formed by the method of this invention are rigid and transmit rapping forces through the entire length of the collecting electrode. That is, the replacement collecting electrodes formed by the method of this invention should be equivalent to a conventional unitary collecting electrode of an electrostatic precipitator which is rigid and essentially formed of a single piece construction. Thus, in the disclosed embodiment, anvil pipes 32 are inserted and permanently secured in the ends of the tubular portions 24 adjacent another collecting electrode section as shown in FIGS. 5 to 7. In one preferred embodiment, the "inner" ends of the anvil pipes are crimped at 34 to provide a stop for the connecting support rods or tubes 36 shown in FIGS. 8 to 10 discussed below. The anvil pipes 32 are then inserted into the ends of the tubular portions 24 as shown in FIGS. 5 and 6 and permanently secured in place as by welding through the slots 30 discussed above and shown in FIGS. 1, 2 and 5 or by other methods including crimping. As will be understood by those skilled in this art, slots may not be required if other methods of permanently securing the anvil pipes 32 in place are utilized. In a preferred embodiment, the anvil pipes 32 have an axial or longitudinal length equal to about one-third of the axial length of the tubular portions 24 as best shown in FIG. 6 and the ends of the anvil pipes 32 are preferably flush with the ends of the tubular portions 24. As will be understood from this description, the upper collecting electrode section 20A includes anvil pipes only at the lower ends of the tubular portions 24 and the lower collecting electrode section 20B has anvil pipes 32 only at the upper ends of the tubular portions 24. Further, in one preferred embodiment, the anvil pipes 32 have an outside diameter substantially equal to or slightly less than the minor diameter of the tubular portions or diamond-shaped "Opzels" 24 to provide a tight or interference fit.

Figure 8:
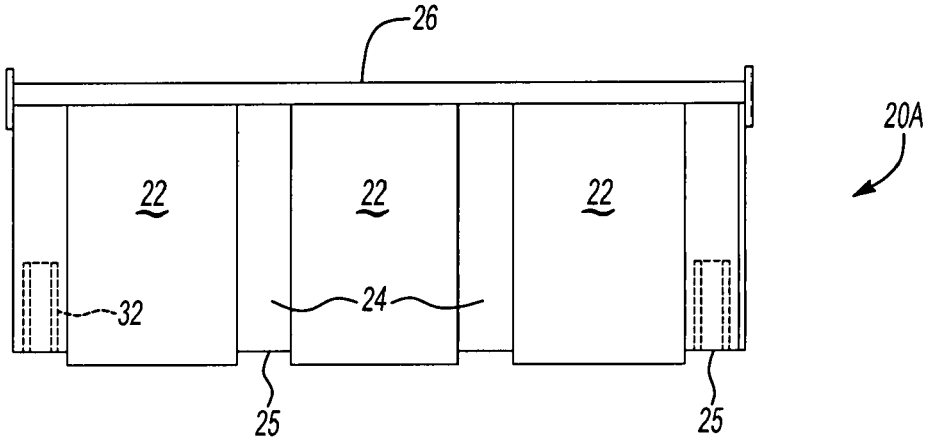
FIGS. 8 to 10 are side views of the collecting electrode sections shown in FIGS. 5 to 7 during installation of interconnecting support tubes.
Figure 9:
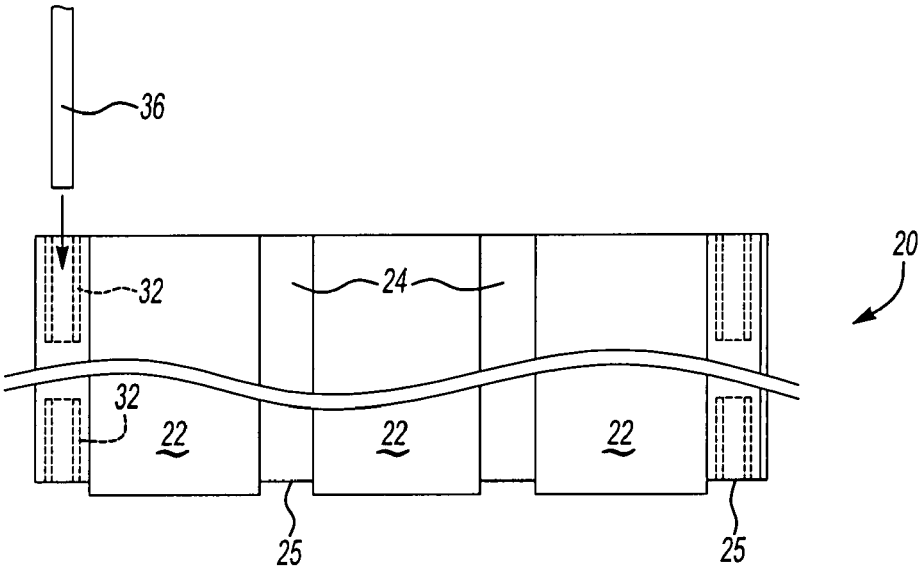
Figure 10:
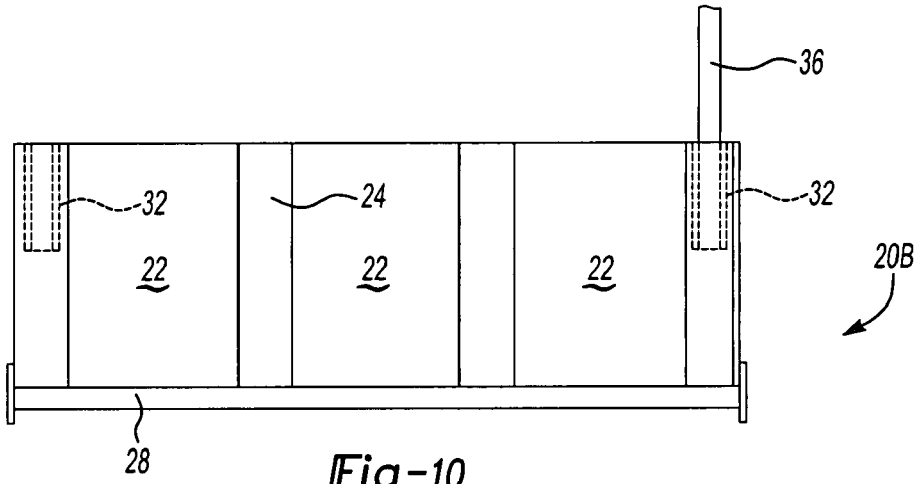

The outside diameter of the connecting or interconnecting support rods or tubes 36 are generally equal to or slightly smaller than an inside diameter of the anvil tubes 32, again to provide a tight or interference fit and the axial length of the connecting support rods 36 is equal to approximately twice the axial length of the anvil tubes 32, such that when the collecting electrode sections 20 (including 20A and 20B) are interconnected, the connecting or interconnecting support rods 36 provide full support for the interconnected collecting electrode sections 20 and when the connecting support rods 36 are inserted into one of the anvil pipes 32 of one section, an equal portion having a length equal to an anvil pipe 32 of the other section projects from the collecting electrode section 20 as shown in FIGS. 8 to 10. As described above, the collecting electrode sections 20 may be temporarily interconnected prior to compression described below by hooks (not shown) received through openings in the tubular portions 24. The top collecting electrode section 20A may be raised on a winch or the like to a vertical position and interconnecting rods 36 are then received in the anvil pipes 32 of an intermediate collecting electrode section 20, as shown in FIG. 9. The intermediate section 20 may then be raised to receive the interconnecting rods 36 of the intermediate section 20 in the anvil pipes 32 of the upper collection electrode section 20A and the intermediate section may then be temporarily interconnected to the upper collecting electrode section 20A by hooks (not shown) or the like. Each intermediate collecting electrode section 20 and finally lower collecting electrode section 20B is interconnected in the same manner. Although a preferred embodiment of the method of this invention includes assembling the anvil pipes 32 in the tubular portions 24 prior to receiving the interconnecting rods 36 in the tubular portions 24 as described above, the anvil pipes 32 are considered optional, but preferred.

Figure 11:
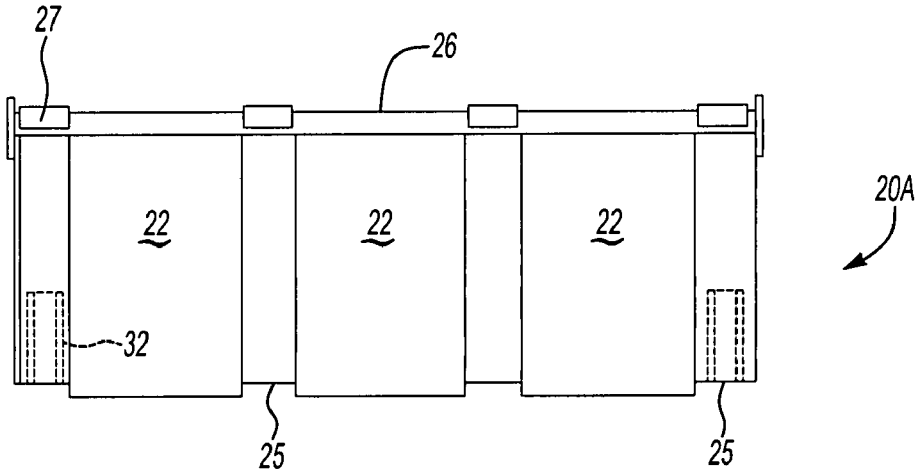
FIGS. 11 to 14 are side views of the collecting electrode sections shown in FIGS. 8 to 10 during installation of Z-bars.
Figure 12:
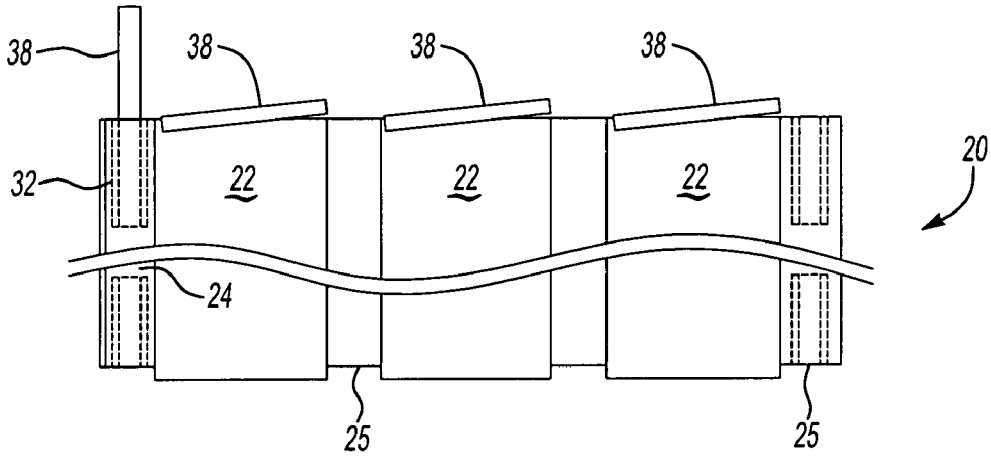
Figure 13:
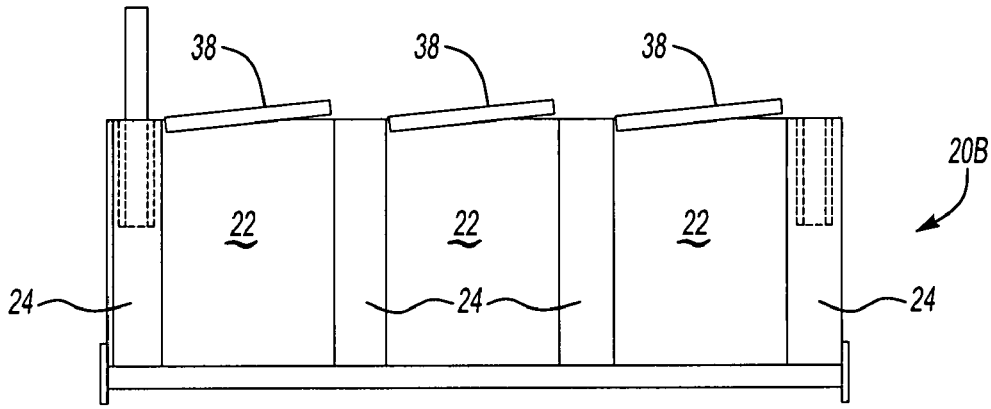
Figure 11A:
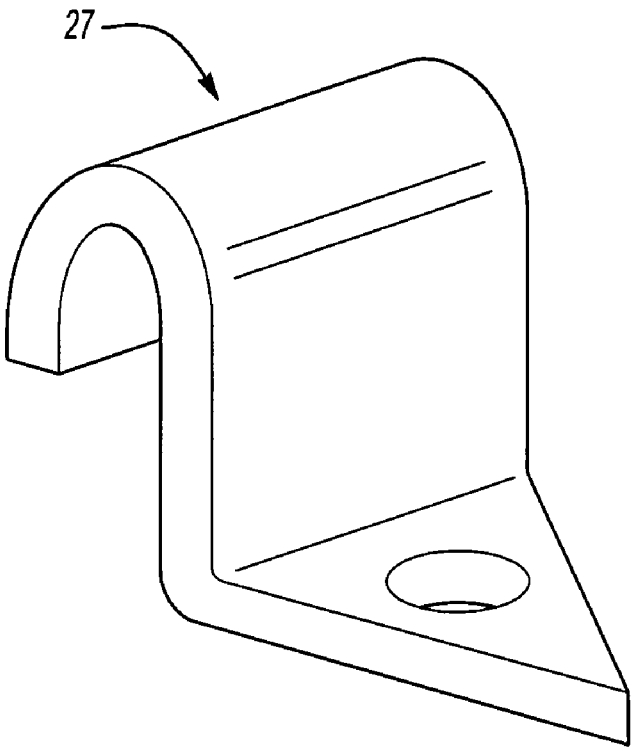
FIG. 11A is a side elevational view of an Opzel cap.
Figure 12A:
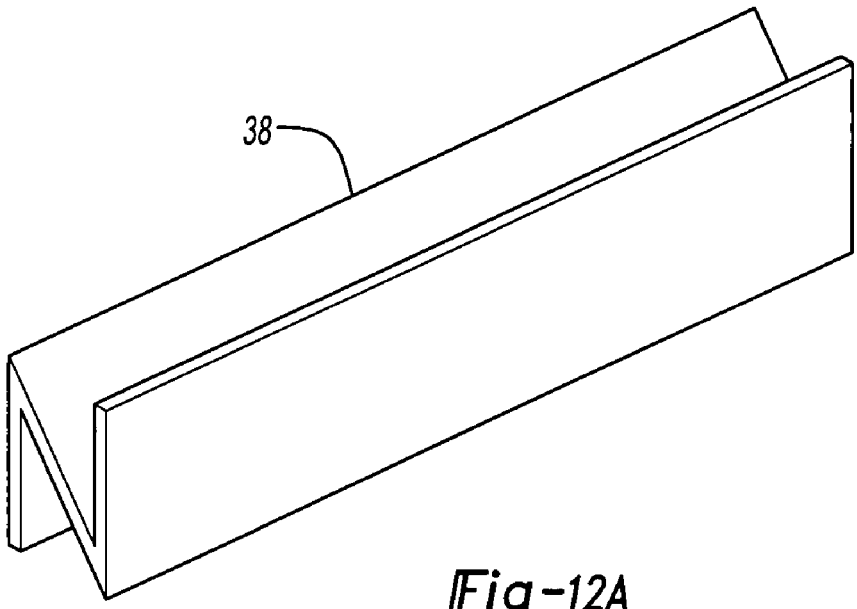
FIG. 12A is an end elevation of a Z-bar.

FIGS. 11 to 13 illustrate one preferred method of providing reinforcing bars between the collecting electrode sections 20. As set forth above, the reinforcing bars or channels 38 provide reinforcement for the interconnected collecting electrode sections 20 and improves transmission of rapping forces through the entire assembled collecting electrode. In the disclosed embodiment, the reinforcing bars 38 are generally Z-shaped in cross-section as shown in FIG. 12A. It has been found that the simplest method of installing the Z-shaped reinforcing bars 38 is to insert the bite or channel of one end portion of the Z-shaped reinforcing bar 38 over an end portion of the planar collecting portions 22 as shown in FIGS. 12 and 13, such that the opposed planar collecting portion is self-guided into the opposed bite portion or channel of the Z-shaped reinforcing bar 38 as the collecting electrode sections are compressed together as described below, whereby the planar collecting portions 22 are rigidly interconnected and overlapped in the opposed bite portions of the Z-shaped reinforcing bar 38. End caps 27 shown in FIG. 11A may be received over the open end of the upper tubular potions 24 as shown in FIG. 11.

The assembled horizontal collecting electrode sections 20 may then be compressed together to form a modular unitary rigid construction by one of at least two preferred embodiments of the method of forming replacement collecting electrodes of this invention. As discussed herein with regard to a preferred method of forming a replacement collecting electrode, the horizontal collecting electrode sections 20 may be interconnected by hooks, clips or other means (not shown) prior to compressing the sections together to form a unitary structure. Two alternative methods are disclosed in this application for compressing the collecting electrode sections 20 together. In the embodiment shown in FIGS. 14 and 15, externally threaded rods 40 are used to compress the collecting electrode sections 20 into a modular rigid structure. In the embodiment shown in FIGS. 14 and 15, an upper section 20A, an intermediate section 20 and a lower section 20B are shown. However, as will be understood, the assembled collecting electrode will include any number of horizontal intermediate collecting electrode sections 20 between the upper collecting electrode section 20A and the lower collecting electrode section 20B. With this disclosed embodiment, the threaded rods are a few inches longer than the section through which it is lowered. This causes it to extend beyond or stick out below the respective section as it is lowered. At this point, the method includes attaching a standard nut 42 and a long extended nut 44 threadably onto the end of the rod. The standard nut 42 is threaded onto the threaded rod 40 and the long extended nut 44 is threaded on the rod until the rod is half way into the nut. The standard nut is now locked down against the extended nut to lock it in place. As will be understood, the use of two nuts, one of which serves as a lock nut is only one method of interconnecting and locking the rods 40 in place and this rod method of compressing the collecting electrode sections 20. A centering punch may be used to damage the thread above the standard nut to prevent it from coming loose again. As will be understood, the upper end of the threaded rod 44 includes a nut 42 which is threaded onto the rod 40 prior to disposing the rod 40 through the connecting support rod which, in this embodiment, is preferably tubular.

When the next collecting electrode section 20 is put into place under the last section, the next threaded rod 40 and nut assembly is added to the first threaded rod, as described above. In this case, a standard hut is installed on the upper portion of the second threaded rod 40, and then the lower threaded rod is threaded into the long nut 44 on the upper threaded rod until it stops against the upper threaded rod. The lower section is now tightened against the extended nut to lock it, and then the nuts may be damaged by a punch to prevent removal. This process is repeated depending upon the number of intermediate sections 20 are used until the lower collecting electrode section 20B is installed and the threaded rod 40 penetrates out through the bottom of the lower section. The threaded rod 40 is now received through the support plate 28 on the bottom plate reinforcing bar and tightened up to a predetermined tightness. A second locking nut is added and then the threads are damaged. During the installation process just described, the projecting portion of the connecting support rods or tubes 36 are telescopically received in the anvil pipes 32 of the next collecting electrode section 20 and as the collecting electrode sections 20 are compressed together, the end of the planar collecting portions 22 are received in a bite of the Z-shaped reinforcing bar 38, compressing the planar collecting plates 22 to form a rigid overlapping assembly.

Figure 16:
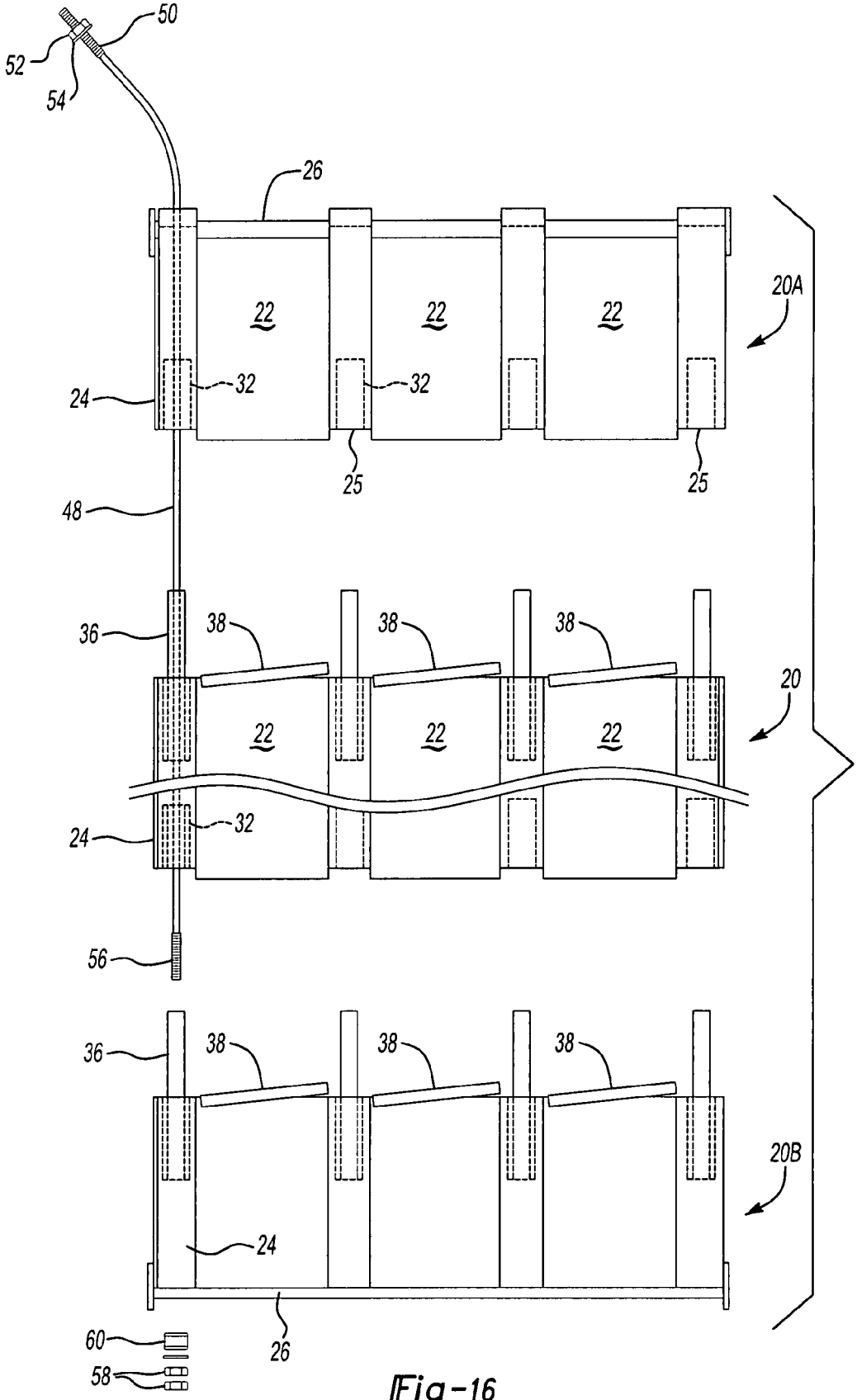
FIG. 16 is are side views of the collecting electrode sections shown in FIGS. 11 to 14 during compression of the sections using a tensioning cable.
Figure 17:
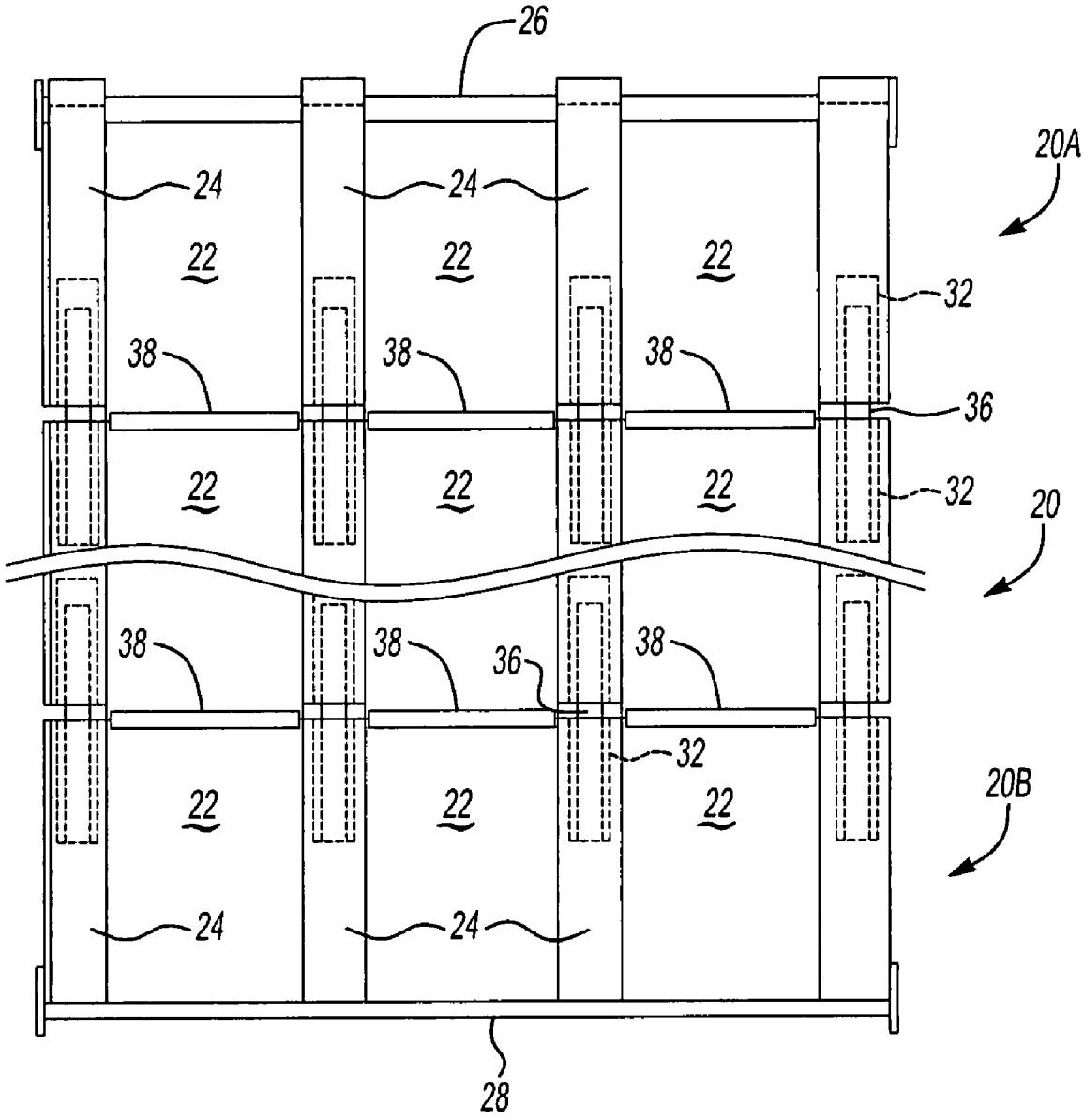
FIG. 17 is a side view of one embodiment of an assembled modular rigid collecting electrode made by the method of this invention.

FIG. 16 illustrates an alternative method of compressing the collecting electrode sections 20 together using cables 48. In this embodiment, a pre-cut, pre-terminated cable 48 is attached to the upper collecting electrode section 20A through an opening (not shown) in the upper stiffening beam or bar 26. The cable is passed down through the tubular portion or "Opzel" 24 until it is received out of the end of the tubular portion 24 of the upper collecting electrode section 20A. The cable is then passed through the tubular portion 24 of the next collecting electrode section 20 and through the intervening collecting electrode sections 20 (not shown) until it received through the tubular portion 24 of the lower collecting electrode section 20B. This process is repeated for each of the tubular portions of the collecting electrode sections 20 (not shown). In the disclosed embodiment, wherein the tubular portions include anvil pipes 32 and connecting support tubes 36, the cable is received through the connecting support tubes 36 as shown in FIG. 16. The upper end of the cable 48 includes an anchor bolt 50, nut 52 which is threaded onto the bolt 50 and washer 54 which prevents the upper end of the cable from passing through the upper stiffening beam 26 which has a hole generally equal to the diameter of the bolt 50. As will be understood, various other anchor devices may be utilized. The lower end of the cable 48 includes a threaded rod 56 permanently attached to the cable 48. The threaded rod is received through an opening (not shown) in the lower stiffening beam 26 of the lower collecting electrode section 20B and it is then tightened up a predetermined amount using the jam nuts 58. A lower "Opzel" cap 60 may also be provided. As described above, as the collecting electrode sections 20 are compressed together by the cable 48, the ends of the planar connecting portions 22 engage the Z-shaped reinforcement bars 38, which are compressed together as further shown in FIG. 17.

In one preferred embodiment of the method of this invention, the upper collecting electrode section 20A is supported on a winch in a vertical position, such as within an electrostatic precipitator, below the upper beam or girder to which the assembled collecting electrode is to be suspended. The winch may be attached to the beam or a truss to raise the collecting sections during assembly as now described. As set forth above, the collecting electrode sections 20 may be manufactured at a manufacturing facility remote from the electrostatic precipitator, wherein the collecting electrode sections 20 are substantially identical as shown in FIGS. 1 to 5 except for the stiffening beams 26 and 28. That is, each collecting electrode section 20 includes a plurality of vertical planar collecting portions 22 separated by parallel vertical tubular portions 24 which, in one preferred embodiment, are diamond-shaped as shown in FIG. 4. However, the method of this invention is not dependent upon the shape of the tubular portions 24 and any tubular shape may be used. Further, the anvil pipes 32 are preferably received within and permanently secured in the tubular portions 24 as described above and disclosed in FIG. 5. As set forth above, the anvil tubes 32 may be welded or otherwise permanently secured within the tubular portions 24 of the collecting electrode sections 20 at the place of manufacture of the collecting electrode sections 20. The "next" collecting electrode section 20 is then aligned beneath the upper collecting electrode section 20A with the tubular portions 24 of the collecting electrode sections coaxially aligned.

Figure 14:
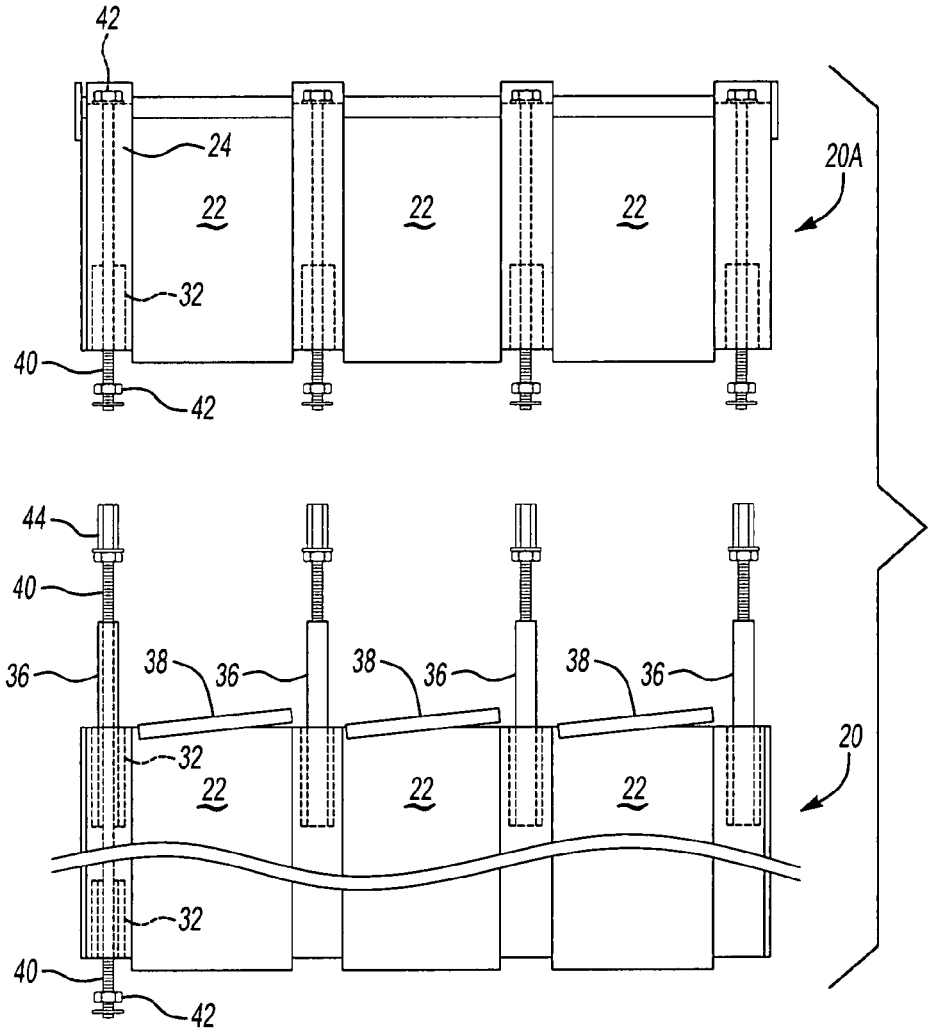
Figure 15:
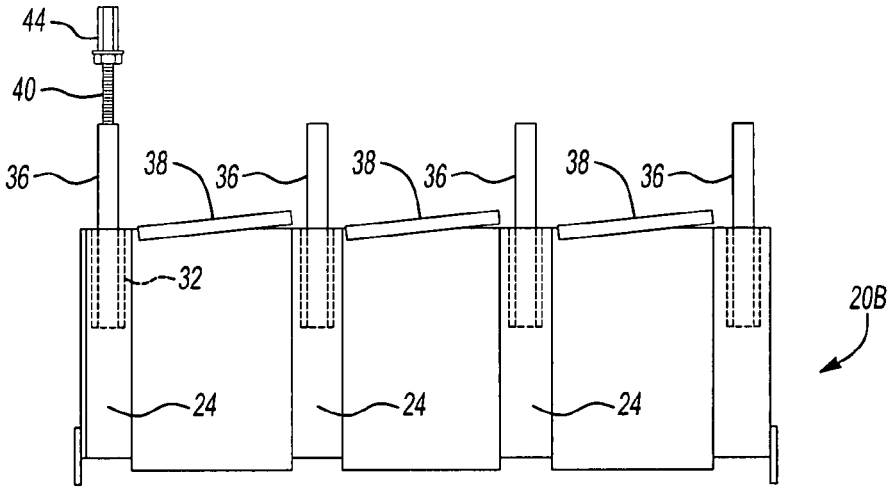

The connecting support rods or tubes 36 are then received in the anvil pipes 32 of the lower or "next" collecting electrode section 20, such that approximately one-half of the connecting support rod 36 projects above the upper end of the next collecting electrode section 20. The projecting portion of the connecting support rod 36 is shown at the right hand of FIG. 10. The upper collecting electrode section 20A is then lowered with the winch or the like to receive the upper portion of the connecting support rods or tubes 36 in the lower section 20 into the anvil tubes 32 of the upper section 20A. Where the collecting electrode sections 20 are interconnected and compressed with the threaded rods 40 as shown in FIGS. 14 and 15, the lower collecting electrode section 20B is then interconnected to and compressed against the upper section 20A. As described herein, in one preferred embodiment, stiffening bars 38, such as the disclosed Z-shaped stiffening bars, are received between the adjacent planar collecting portions 24 prior to compressing the upper section 28 to the intermediate section 20 as described above. However, where the entire assembly is compressed as shown, for example, in FIG. 14, the intermediate collecting electrode section 20 may be temporarily connected to the upper collecting electrode section 20A by any suitable means, such as a U-shaped clip received through slots or openings (not shown) in the tubular portions 24. The process of interconnecting the collecting electrode section 20 is then repeated until the lower section 20B is connected to the next adjacent intermediate collecting electrode section 20 as described above. Each time the next collecting electrode section is to be connected to an intermediate collecting electrode section 20, the assembly is raised by a winch or hoist a distance sufficient to attach the next collecting electrode section 20.

As will be understood from this description, the method of making a replacement collecting electrode for an electrostatic precipitator of this invention has many advantages. First, the components, including the collecting electrode sections 20 may be made at a remote manufacturing facility and easily shipped to the electrostatic precipitator for replacement of the large unitary rigid collecting electrodes. Further, the collecting electrode sections may be assembled into a rigid assembly without any special tools. No welding is required at the electrostatic precipitator and heavy cranes are not required. A simple winch assembly and conventional tools may be utilized to form a rigid replacement collecting electrode of this invention. The rigid modular collecting electrode assembly formed by the method of this invention, particularly including the Z-shaped reinforcing bars 38, assures that rapping forces are transmitted through the entire replacement collecting electrode assembly. Further, the design of the modular collecting electrode formed by the method of this invention guarantees absolute alignment and integrity through all conditions of expansion and contraction created by changing in the operating temperature of the electrostatic precipitator. The "Z-Bar" joint system 38 also provides a combination overlap and connection system in a low profile connecting device. As will be understood from the above description of the preferred embodiments of the method of this invention, various modifications may be made within the purview of the appended claims. Having described preferred embodiments of the method of making a replacement collecting electrode for an electrostatic precipitator of this invention, the invention is now claimed as set forth below.

The invention claimed is:

1. A method of making a replacement collecting electrode for an electrostatic precipitator, comprising the following steps:

forming a plurality of collecting electrode sections, each section including spaced aligned planar collecting portions separated by spaced vertical tubular portions, wherein the tubular portions of the collecting electrode sections can be coaxially aligned;

aligning a plurality of collecting electrode sections with spaced vertical tubular portions coaxially aligned;

inserting interconnecting support rods into opposed tubular portions of adjacent collecting electrode sections and forming a plurality of interconnected collecting electrode sections; and compressing the interconnected collecting electrode sections to form a rigid modular assembly of interconnected collecting sections able to transmit and withstand rapping forces in an electrostatic precipitator.

2. The method as defined in claim 1, wherein said method includes the following steps:

hanging a first of the collecting electrode sections, such that the planar collecting portions and tubular portions extend vertically;

inserting the interconnecting support rods into the tubular portions of a second vertical collecting section with the interconnecting support rods projecting from the tubular portions of the second vertical collecting section;

vertically aligning the second vertical collecting section with the first collecting section with the projecting interconnecting rods coaxially aligned with the tubular portions of the first vertical collecting section; and bringing together the first and second collecting electrode sections, receiving the projecting interconnecting support rods of the second collecting section into the tubular portions of the first collecting section and interconnecting the first and second vertical collecting sections.

3. The method as defined in claim 1, wherein said method includes interconnecting adjacent vertical collecting sections prior to compressing the interconnected collecting sections.

4. The method as defined in claim 3, wherein said method includes interconnecting adjacent vertical collecting sections with clips.

5. The method as defined in claim 1, wherein said method includes inserting anvil pipes into the opposed ends of the tubular portions of adjacent vertical collecting sections, then inserting said interconnected support rods having an outside diameter generally equal to an inside diameter of said anvil pipes into said anvil pipes located in said tubular portions of said vertical collecting sections.

6. The method as defined in claim 5, wherein said method includes permanently securing said anvil pipes in said tubular portions of said collecting electrode sections.

7. The method as defined in claim 6, wherein said method includes inserting an anvil pipe in each of the opposed ends of the tubular portions of adjacent collecting electrode sections adjacent an open end of said tubular portions, then welding said anvil pipes in said tubular portions.

8. The method as defined in claim 1, wherein said interconnecting support rods are tubular and said method includes inserting interconnecting elements into the tubular support rods of adjacent collecting electrode sections.

9. The method as defined in claim 8, wherein said method includes inserting an elongated compression member through the tubular interconnecting support rods and shortening the length of the elongated compression member to compress the assembly.

10. The method as defined in claim 1, wherein said method includes applying a stiffening member across the ends of the planar portions of each of adjacent collecting electrode sections.

11. The method as defined in claim 9, wherein said method includes applying a Z-shaped bar between adjacent planar portions of said vertical collecting sections, receiving an edge of the opposed planar collecting portions in opposed sides of the Z-shaped bar.

12. A method of forming a modular collecting electrode for an electrostatic precipitator, comprising the following steps:

forming a plurality of horizontal collecting electrode sections, each section including spaced vertical planar collecting portions separated by spaced vertical tubular portions, wherein the tubular portions of the sections are spaced to be coaxially aligned;

inserting anvil pipes into tubular portions of the collecting electrode sections;

inserting an interconnecting support rod into at least one of the anvil pipes of one of the tubular portions having a length greater than the tubular portion, such that an interconnecting portion extends beyond the tubular portion;

inserting the interconnecting portion of the interconnecting support rod into an anvil pipe of an adjacent horizontal collecting electrode section; and compressing the interconnected collecting electrode sections to form a rigid modular assembly of interconnected collecting electrode sections able to transmit and withstand rapping forces in an electrostatic precipitator.

13. The method as defined in claim 12, wherein said method includes interconnecting adjacent collecting electrode sections with clips prior to compressing the interconnected collecting electrode sections.

14. The method as defined in claim 12, wherein said method includes applying stiffening members across the ends of the vertical planar collecting portions.

15. The method as defined in claim 14, wherein said method includes applying a stiffening member between adjacent planar collecting portions having opposed channel-shaped portions receiving an edge of the opposed planar collecting portions.

16. A method of forming a modular collecting electrode for an electrostatic precipitator, comprising the following steps:

forming a plurality of horizontal collecting electrode sections, each section including spaced vertical planar collecting portions separated by vertical tubular portions, wherein the tubular portions of the horizontal collecting electrode sections are spaced to be coaxially aligned;

inserting interconnecting support rods into opposed tubular portions of adjacent collecting electrode sections having a length greater than a length of the tubular portions, such that an interconnecting portion extends beyond the tubular portion;

applying a stiffening member across the ends of the planar collecting portion, each having opposed channel-shaped portions;

inserting the interconnecting portion of the interconnecting support rod into a tubular portion of an adjacent horizontal collecting electrode section; and compressing the interconnected collecting electrode sections to form a rigid modular assembly of interconnected collecting electrode sections able to transmit and withstand rapping forces in an electrostatic precipitator.

17. The method as defined in claim 16, wherein said method includes inserting anvil pipes in the tubular portions of the collecting electrode sections and inserting the interconnecting support rods in the anvil pipes.

18. The method as defined in claim 16, wherein said method includes inserting threaded rods through said tubular portions and compressing the interconnected collecting electrode sections by threading nuts on said rods.

19. The method as defined in claim 16, wherein said method includes inserting a flexible cable through the tubular portions of adjacent horizontal collecting electrode sections and tensioning said cable to compress the interconnected collecting electrode sections.

* * * * *